US006356242B1

(12) United States Patent
Ploussios

(10) Patent No.: US 6,356,242 B1
(45) Date of Patent: Mar. 12, 2002

(54) CROSSED BENT MONOPOLE DOUBLETS

(76) Inventor: George Ploussios, 60 Central St., Andover, MA (US) 01810

( * ) Notice: Subject to any disclaimer, the term of this patent is extended or adjusted under 35 U.S.C. 154(b) by 0 days.

(21) Appl. No.: 09/492,958

(22) Filed: Jan. 27, 2000

(51) Int. Cl.[7] ..... H01Q 21/26
(52) U.S. Cl. ..... 343/795; 343/797; 343/846
(58) Field of Search ..... 343/846, 853, 343/844, 742, 797, 828, 829, 795; H01Q 21/24, 21/26

(56) References Cited

U.S. PATENT DOCUMENTS

| | | | | |
|---|---|---|---|---|
| 3,725,943 A | * | 4/1973 | Spanos | 343/797 |
| 4,125,839 A | | 11/1978 | Kaloi | 343/700 MS |
| 4,443,800 A | | 4/1984 | Galione | 342/372 |
| 4,611,212 A | * | 9/1986 | Lee | 343/844 |
| 4,635,065 A | * | 1/1987 | Mori et al. | 343/846 |
| 4,684,953 A | | 8/1987 | Hall | 343/725 |
| 4,814,777 A | | 3/1989 | Monser | 343/727 |
| 5,146,232 A | | 9/1992 | Nishikawa et al. | 343/713 |
| 5,291,210 A | | 3/1994 | Nakase | 343/700 MS |
| 5,325,403 A | | 6/1994 | Siwiwak et al. | 375/100 |
| 5,654,724 A | * | 8/1997 | Chu | 343/846 |
| 5,719,794 A | | 2/1998 | Altshuler et al. | 364/512 |
| 5,757,333 A | | 5/1998 | Kitchener | 343/826 |
| 5,760,747 A | | 6/1998 | McCoy et al. | 343/728 |
| 5,771,025 A | | 6/1998 | Reece et al. | 343/828 |
| 5,784,032 A | * | 7/1998 | Johnston et al. | 343/742 |
| 5,821,902 A | | 10/1998 | Keen | 343/700 MS |
| 5,894,287 A | | 4/1999 | An et al. | 343/700 MS |

* cited by examiner

*Primary Examiner*—Michael C. Wimer
(74) *Attorney, Agent, or Firm*—Devine, Millimet & Branch, P.A.; Paul C. Remus; Todd A. Sullivan

(57) ABSTRACT

An antenna comprising a pair of bent monopole elements (a doublet) that are fed in a manner that results in elevation coverage from the horizon to horizon and dual polarization. Two orthogonal bent monopole doublets provide hemispherical coverage with horizontal and vertical polarization. Combining the doublet terminals through a processing circuit will provide polarization diversity and/or angle diversity capability.

26 Claims, 15 Drawing Sheets

PORT 1

| | |
|---|---|
| xxx | HP Gain, Theta-30 |
| oo | VP Gain, Theta-30 |

PORT 2

HP Gain, Theta-30
VP Gain, Theta-30

FIG.10A
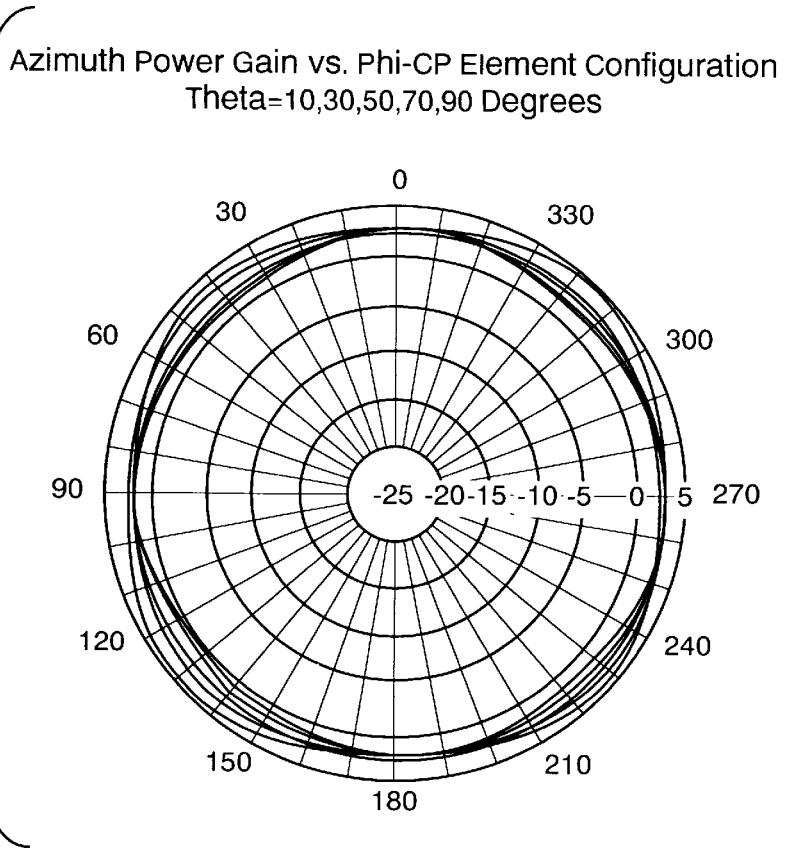
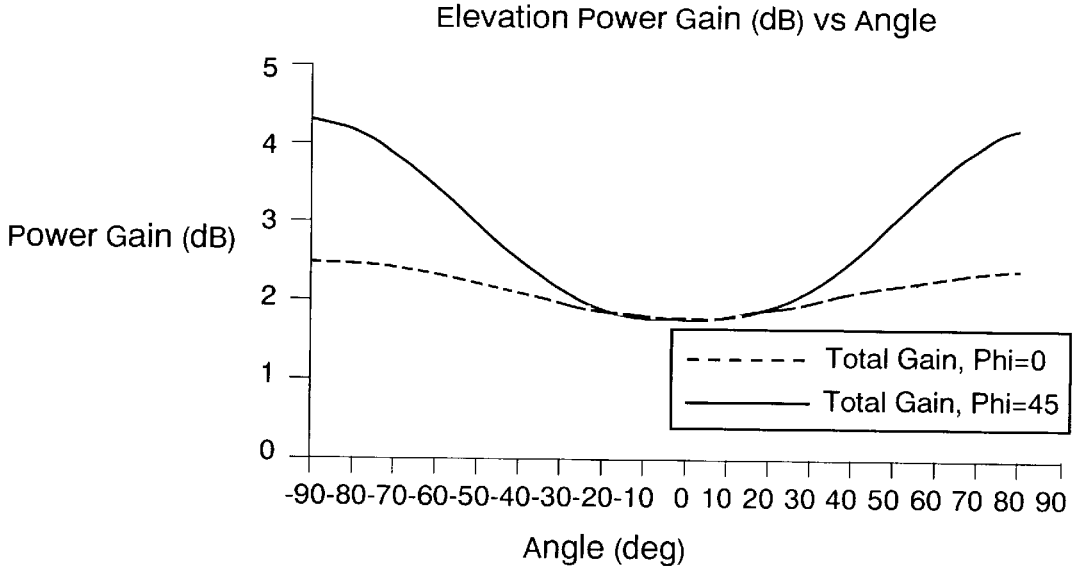
FIG. 10B

CROSSED BENT MONOPOLE DOUBLETS

FIELD OF THE INVENTION

This invention relates generally to an antenna and, more particularly, to an antenna for transmitting and receiving electromagnetic radiation signals to and from fixed or mobile communication platforms.

BACKGROUND OF THE INVENTION

The signal fading problems associated with fixed and mobile communications platforms in a multipath environment have been and continue to be studied to determine antenna and data processing designs that solve the problems in a cost-effective manner. From an antenna standpoint, previous designs have included the use of adaptive arrays and space diversity antennas. In recent years, studies have shown that frequency diversity techniques that utilize antennas with orthogonal polarization ports result in performance at least comparable to systems using space diversity.

The angular coverage desired from communications antennas, other than fixed point-to-point systems, is very large, typically equal to or approaching instantaneous hemispherical coverage. Earlier antenna designs that best achieved hemispherical coverage utilize a turnstile antenna plus a monopole antenna switched to achieve high or low angle coverage. The height of these designs range from about 0.4 to 0.5 wavelengths at the system's operating frequency. The Rodal design is a modified version of the turnstile antenna that uses curved dipole elements and provides nearly hemispherical coverage without switching. See Rodal et al., U.S. Pat. No. 5,173,715. Rodal et al. is incorporated herein by this reference. The Rodal design is still too large for many applications with heights greater than or equal to one quarter wavelength and is a single port single polarization design.

Recently Altshuler described a simpler, non-switching design that provides hemispherical coverage. This however is not a low profile design and does not provide dual polarization outputs. See Edward E. Altshuler. Derek S. Linden, "Design of a Vehicular Antenna for GPS/Iridium Using a Genetic Algorithm."

Diversity antenna designs using crossed loop conductors have been used to combat multipath interference. See Lee, U.S. Pat. No. 4,611,212, and Johnston, et al., U.S. Pat. No. 5,784,032. Lee and Johnston et al. are incorporated herein by this reference. Both designs are narrow band designs. The Lee design is a receive antenna design. The Johnston design requires impedance matching with reactive components and does not offer the possibility of combining antenna signals to generate instantaneous hemispherical coverage.

What is needed is a low profile transmit and receive antenna design that provides (a) circular polarized hemispherical coverage using a single port output, and/or (b) orthogonal linear or circular polarized coverage using a two port output. A simple antenna design that can have an operating bandwidth >25% and that provides one or both of these modes of operation would be an improvement over the present state of the art.

SUMMARY OF THE INVENTION

It is therefore an object of this invention to provide a novel, inexpensive and highly effective low-profile antenna that is useful in both heavy multipath and minimal multipath environments. It is a further object of this invention to provide an improved, low-profile circular polarized antenna that has instantaneous coverage over a hemisphere of solid angle.

It is a further object of this invention to provide an improved, low-profile circular polarized antenna that has essentially uniform gain over a hemisphere of solid angle.

It is a further object of this invention to provide an improved, low-profile antenna that can generate a scannable, directive dual linear polarized pattern with coverage down to the horizon with scannable or switchable peaks and nulls in the azimuth plane.

It is a further object of this invention to provide an improved, low-profile two port antenna that generates dual linear polarized hemispherical coverage.

It is a further object of this invention to provide an improved, low-profile antenna with typical design dimensions of between 0.05 to 0.15 wavelengths in height by less than or equal to one-half wavelength in diameter at the desired operating frequency.

This invention results from the realization that pairs of appropriately shaped bent monopole elements that are properly oriented and properly fed form a bent monopole doublet that will provide horizon to zenith to horizon coverage. When two of these element pairs are orthogonally located and fed in phase quadrature, the result is a circular polarized antenna with hemispherical coverage. Moreover, the gain over the hemisphere can be tailored to have higher gain at low or high angles or to have uniform gain over the entire hemisphere. The two orthogonal bent monopole doublets formed provide orthogonal polarized and orthogonal angular patterns that can be processed for polarization diversity or angle diversity to mitigate multipath. If the bent monopoles are designed to be self-resonant the need for frequency bandwidth limiting reactive tuning is eliminated.

This invention most basically features an antenna comprising a ground plane having a first surface; a first pair of spaced antenna elements extending from the first surface of the ground plane; and a second pair of spaced antenna elements orthogonal to the first pair of elements and extending from the first surface of the ground plane, such that the centerpoint between each pair of antenna elements is identical. The antenna elements are preferably designed to be self-resonant. This is readily achieved by selecting the appropriate element length and geometry. Where reduced size is of greater importance than bandwidth smaller, non-resonant elements may be used with reactive tuning elements added to achieve good impedance match. At least one antenna element extends from the first surface of the ground plane and bends towards the antenna centerline that extends along an axis normal to the ground plane such that a vector representative of the element has both horizontal and vertical components as viewed against the ground plane.

The bent element, in some implementations, can be described as an asymmetric top loaded monopole with the greatest amount of top loading directed towards the antenna centerline that extends along an axis normal to the ground plane.

The first pair of antenna elements comprise first and second antenna elements, having first and second feed points respectively. The second pair of elements comprises third and fourth antenna elements having third and fourth feed points respectively. The feed points supply electrical signals to and receive electrical signals from the antenna elements. The feed points for each antenna element pair are a distance of up to and including approximately one-half wavelength apart at an operating frequency of the antenna. There may be at least one splitter/combiner having at least two input terminals and at least one output terminal. The input terminals are electrically coupled to separate antenna feed points, and the splitter/combiner is used for splitting and combining electrical signals when transmitting and receiving signals respectively.

The output ports can be combined using passive or active circuitry to achieve the desired coverage and polarization diversity.

BRIEF DESCRIPTION OF THE DRAWINGS

The novel features believed characteristic of the invention are set forth in the appended claims. The invention itself however, as well as other features and advantages thereof, will be best understood by reference to the description which follows, read in conjunction with the accompanying drawings, wherein:

FIG. 10 is a schematic illustrating the azimuth and elevation patterns of another embodiment of the present invention with an infinite ground plane.

DETAILED DESCRIPTION OF THE INVENTION

Figure 1:
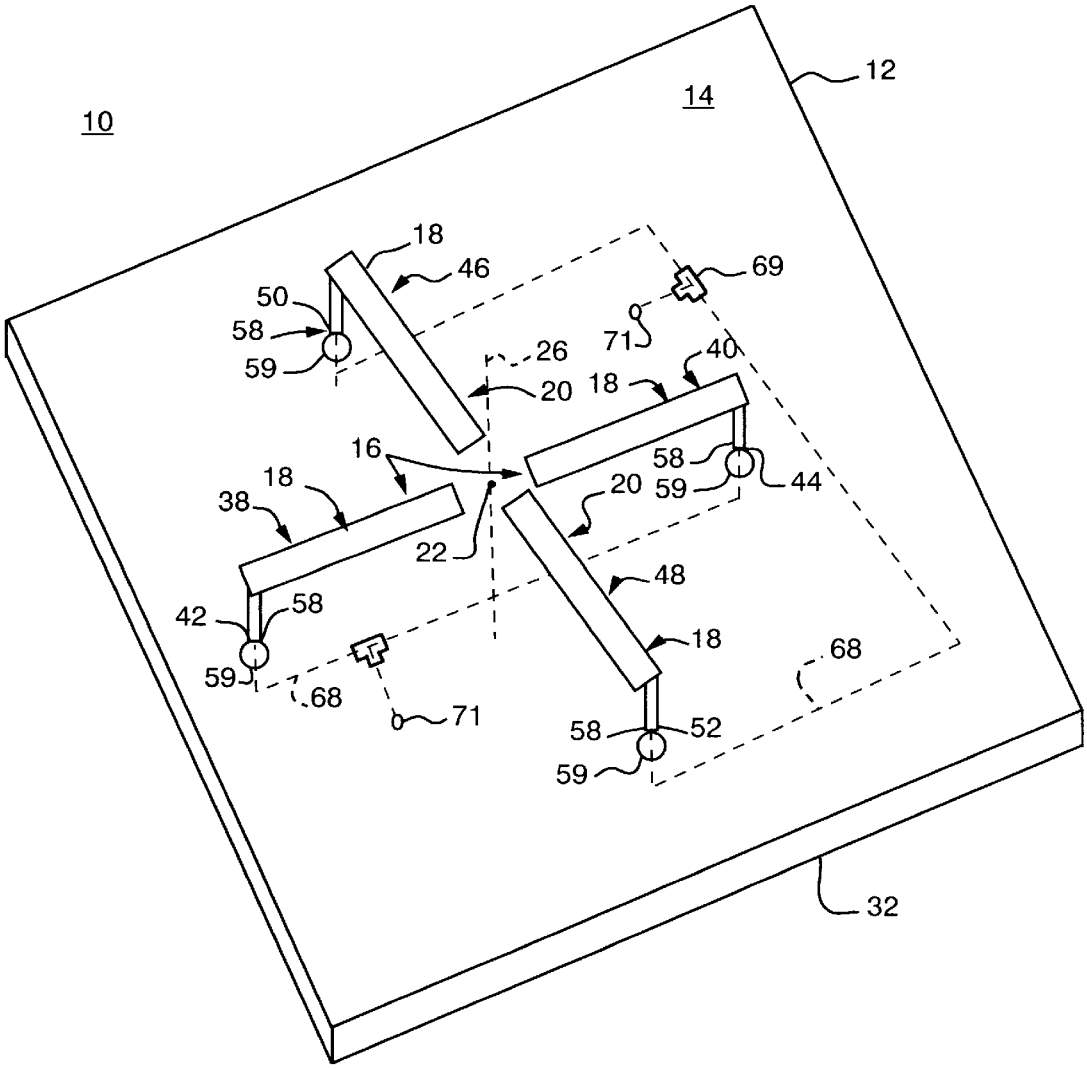
FIG. 1 is a schematic showing an arrangement of antenna elements according to one aspect of the invention.

There is shown in FIG. 1 a schematic showing an embodiment of antenna 10 comprising ground plane 12, which has first surface 14. Antenna 10 also comprises first pair 16 of spaced, antenna elements 18, which extend from first surface 14 of ground plane 12. In this embodiment each element in the first pair 16 of antenna elements 18 is resonant. Additionally, second pair of spaced, self-resonant antenna elements 18 extend from first surface 14 of ground plane 12. Second pair 20 of spaced antenna elements 18 are orthogonal to first pair 16 of elements 18.

As shown in FIG. 1, antenna 10 has an identical centerpoint 22 between pairs 16 and 20 of antenna elements 18. This identical centerpoint 22 allows both pairs 16 and 20 of elements 18 to have common phase centers.

Figure 2:
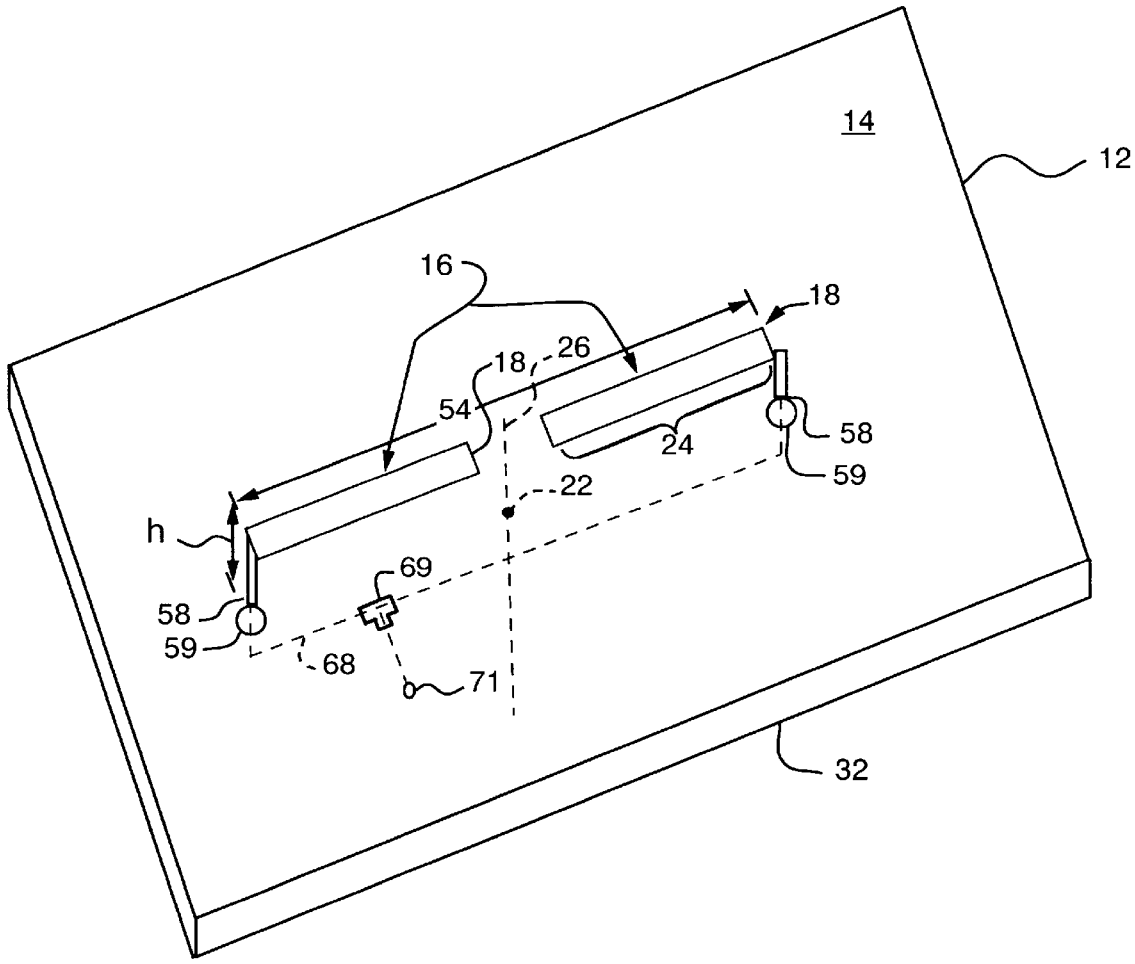
FIG. 2 is another schematic illustrating an arrangement of one pair of antenna elements according to one aspect of the invention.

In this embodiment, antenna 10 has all antenna elements 18 as L-shaped, or asymmetrically top-loaded monopoles. FIG. 2 provides a better view of top loaded section 24 of antenna element 18. The cross-section of top loading section 24 may be rectangular in shape, but other shapes such as triangles, cylinders and cones, as well as other shapes known in the art, are contemplated by this invention.

Antenna 10 has the greatest amount of top loading on each asymmetrically top-loaded antenna element 18 directed towards antenna centerline 26, which extends along an axis normal to ground plane 12. A printed circuit board fabrication may also be used in the implementation of antenna element 18.

As shown in FIGS. 1 and 2, a preferred embodiment of antenna 10 comprises separate feed points 58 for supplying electrical signals to, and receiving electrical signals from, antenna elements 18. First pair 16 of antenna elements 18 comprise first antenna element 38 and second antenna element 40, which have first feed point 42 and second feed point 44, respectively.

Second pair 20 of elements 18 comprise third antenna element 46 and fourth antenna element 48, which have third feed point 50 and fourth feed point 52, respectively. Antenna feed points 58 may pass through vias 59 in ground plane 12, but can also remain above first surface 14 of ground plane 12. Antenna feed points 58 receive and transmit electrical signals along electrical coupling 68. Electrical coupling 68 may comprise microstrip transmission line, coaxial cable, waveguide or other signal transmission devices known to those skilled in the art.

As partially depicted in FIG. 2, one embodiment of the present invention uses feed points 58 for each antenna element pair 16 that are distance 54 apart. Distance 54 equals up to and includes distances of approximately one-half signal wavelength at a predetermined operating frequency of antenna 10.

Antenna 10 further comprises splitter/combiners 69 having at least two input terminals and at least one output terminal, the input terminals electrically coupled to separate antenna feed points through electrical coupling 68. Splitter/combiners split and combine electrical signals when transmitting and receiving signals respectively. In the embodiment represented in FIG. 1, splitter/combiners 69 are "T" splitter/combiners. In this embodiment, the length of electrical coupling 68 between separate antenna feed points 58 and the splitter/combiner input terminal differs by approximately one-half wavelength at an operating frequency of the antenna. The output of splitter/combiners 69 connect to two main ports 71 of the antenna.

Figure 3:
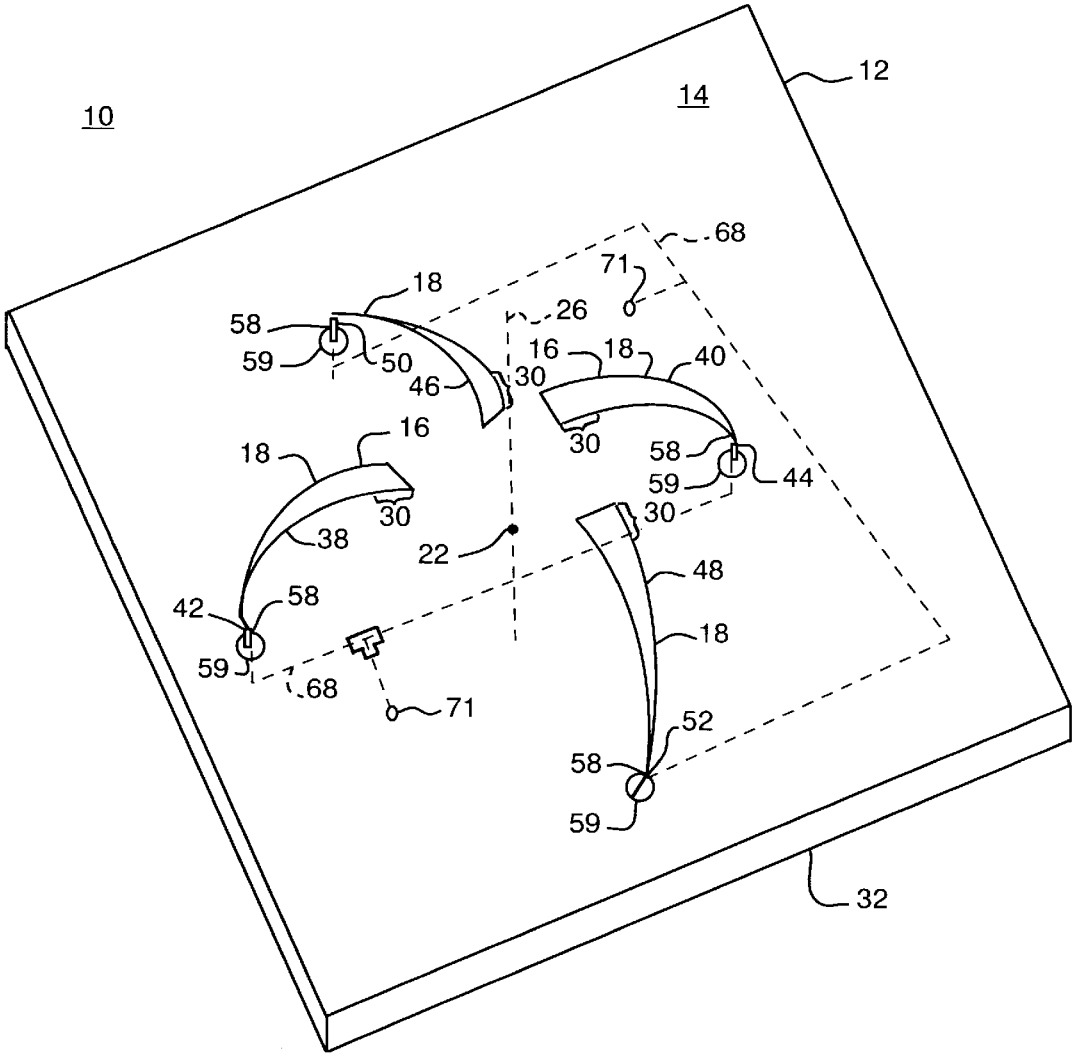
FIG. 3 is another schematic showing an arrangement of bent antenna elements according to one aspect of the invention.

FIG. 3 illustrates another embodiment of the invention. In this embodiment, the antenna elements 18 extend from first surface 14 of ground plane 12 and bend toward antenna centerline 26. Centerline 26 extends along an axis normal to ground plane 12. Element 18 bends such that a vector representative of the element has at least some horizontal components viewed against ground plane 12.

As shown in FIG. 3, one preferred embodiment of the invention comprises four antenna elements 18 that extend from first surface 14 of ground plane 12 and bend toward antenna centerline 26. This design is in contrast to the design in FIGS. 1 and 2 where the bends in antenna elements 18 are 90 degree bends.

Figure 4A:
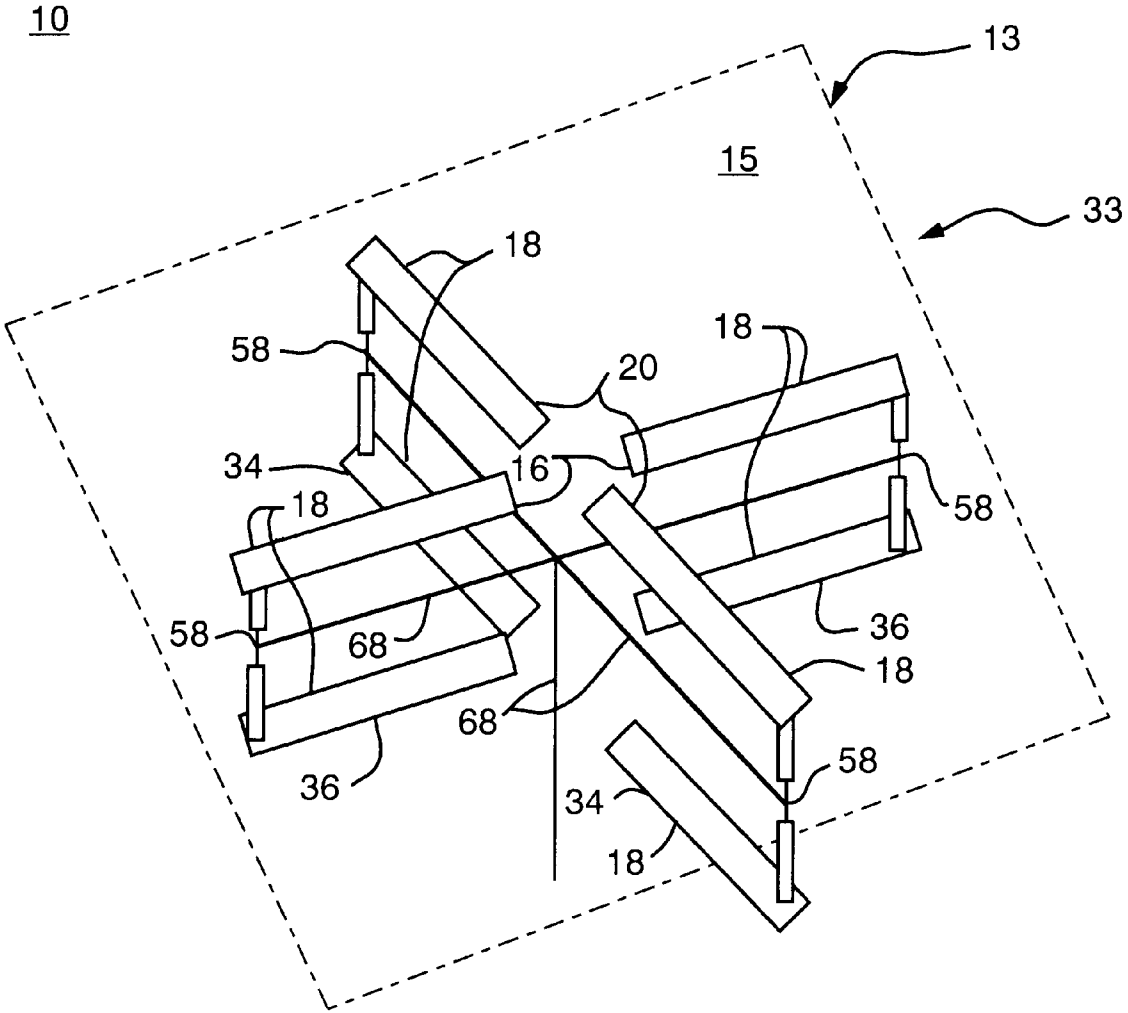
FIG. 4 is another schematic showing an isotropic radiator arrangement of antenna elements according to one aspect of the invention.
Figure 4B:
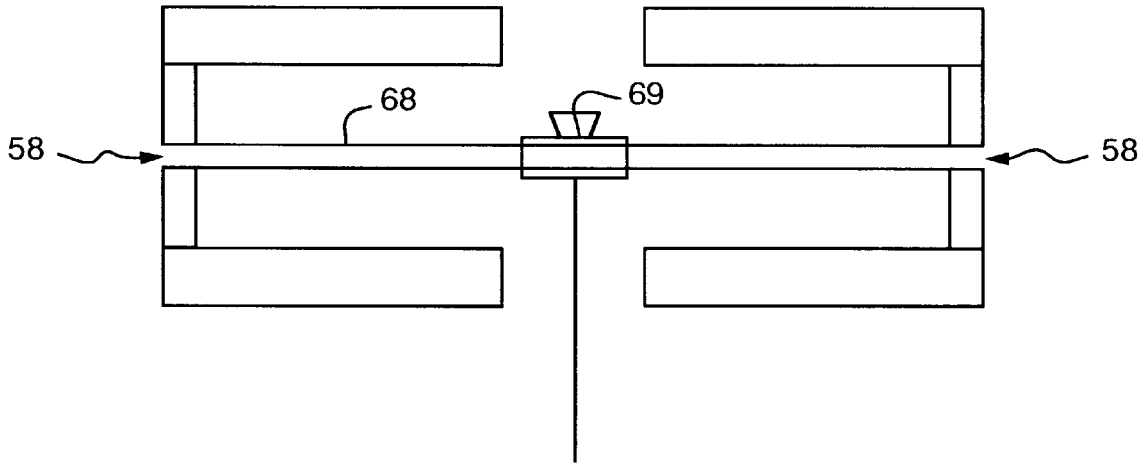

FIGS. 4*a* and b show an alternative embodiment of the present invention. As FIG. 4*a* illustrates, antenna 10 has elements 18 arranged about an imaginary ground plane 13 with first surface 15 and second surface 33. Antenna 10 comprises a first pair 16 of spaced antenna elements 18 extending from first surface 15 of imaginary ground plane 13. Antenna 10 further comprises second pair 20 of spaced, self-resonant antenna elements 18 orthogonal to first pair 16 of elements 18, which also extending from first surface 15 of imaginary ground plane 13. These two pairs of elements are arranged such that the centerpoint between the first and second pairs of antenna elements is identical. Beyond these components, antenna 10 further comprises third pair 34 of spaced antenna elements 18 extending from the second surface 33 of imaginary ground plane 13 and in line with second pair 20 of spaced antenna elements. Finally, antenna 10 comprises fourth pair 36 of spaced, self-resonant antenna elements 18, which are orthogonal to third pair 34 of elements 18 extending from the second surface 33 of imaginary ground plane 13 and in line with first pair 16 of spaced antenna elements, such that the centerpoint between the third 34 and fourth pair 36 of antenna elements 18 is identical. Whereas the antenna feed points 58 in FIG. 3 are coupled to a splitter/combiner 69 through unbalanced transmission line such as coaxial cable or microstrip, in this embodiment the feed points 58 are connected to a splitter/combiner 69 via balanced transmission lines as illustrated in FIG. 4*b*. The design can now be described as consisting of asymmetrically top loaded dipoles or U shaped dipoles. The physical presence of the balanced transmission line feed 68 and splitter/combiner 69 does not effect the radiation pattern as long as the are contained and lie in the plane of the U shaped dipoles and the output line runs along the vertical centerline of the antenna. This embodiment simultaneously generates hemispherical patterns away from first surface 15 and second surface 33 of imaginary ground plane 13, resulting in complete isotropic coverage.

Figure 5A:
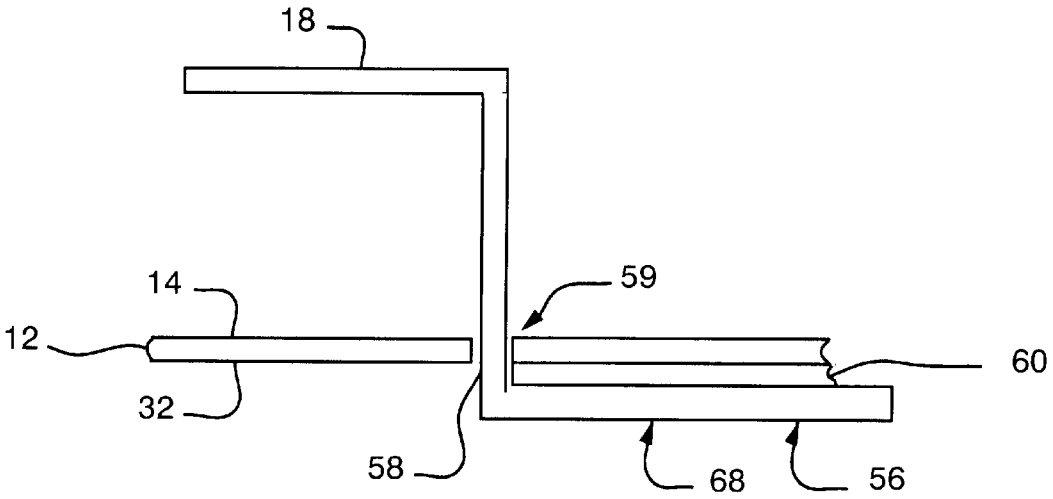
FIG. 5 is a plan view showing two possible arrangements of the antenna elements and microstrip feed lines according to one aspect of the invention.

FIGS. 5*a* and b show two views of contemplated embodiments of the present invention with respect to microstrip transmission line. As shown in previous drawings, electrical coupling 68 may be used to transfer electrical signals to and from antenna feed points 58. In one embodiment of the present invention, antenna 10 includes at least one microstrip transmission line 56 used as electrical coupling 68, which is electrically coupled to at least one element feed point 58.

FIG. 5*a* shows an embodiment wherein microstrip transmission line 56 is mounted on the opposite side of ground plane 12 from antenna element 18. In this embodiment, antenna element 18 is positioned above first surface 14 of ground plane 12. Microstrip transmission line 56 is mounted on dielectric substrate 60, which is, in turn, mounted to second surface 32 of ground plane 12. Antenna feed points 58 pass through vias 59 in ground plane 12.

Figure 5B:
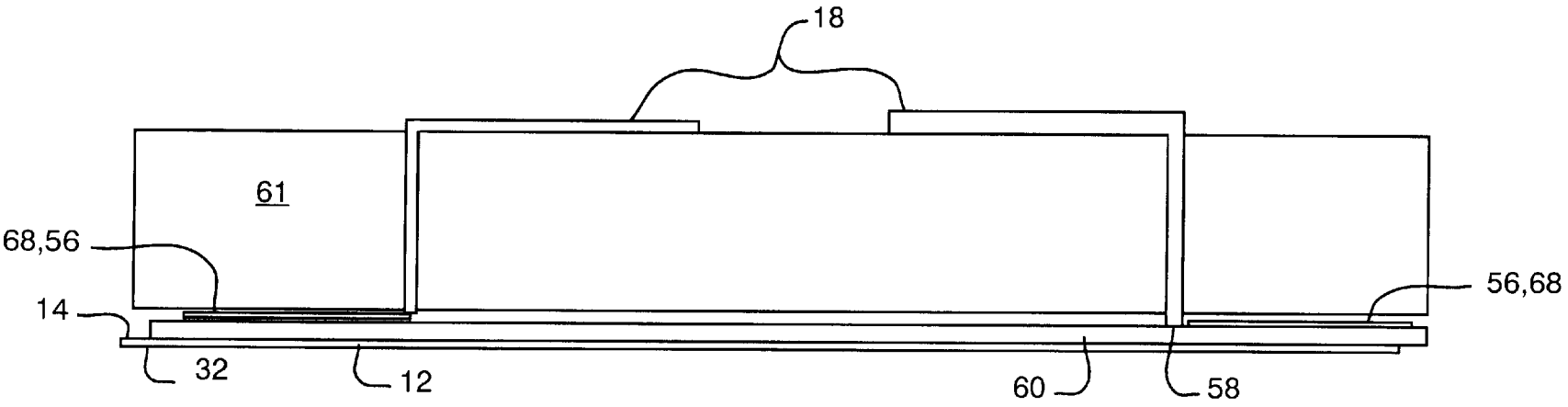

FIG. 5*b* shows another embodiment of the current invention wherein microstrip transmission line 56 and antenna elements 18 are both located on the same side of ground plane 12. In this embodiment, microstrip transmission line 56 is coupled to dielectric substrate 60, which is in turn coupled to first surface 14 of ground plane 12. Also shown in FIG. 5*b* is low density dielectric spacer 61 mounted between microstrip transmission line 56 and antenna element 18. Low density dielectric spacer 61 may be printed circuit board substrate if a printed circuit board fabrication is used as antenna element 18. This low density dielectric spacer may also be used in the configuration in FIG. 5*a*.

Figure 6:
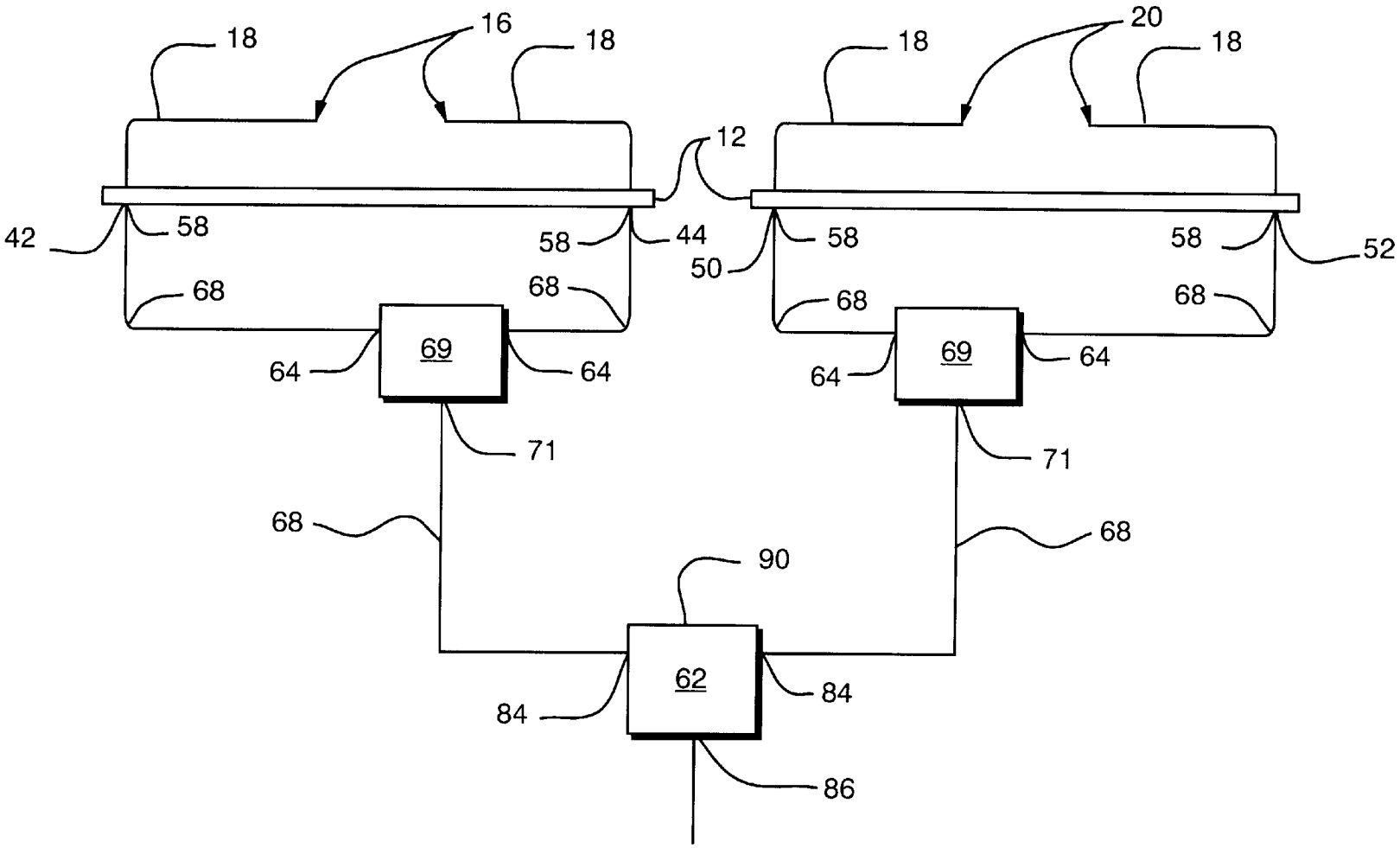
FIG. 6 is a schematic showing an embodiment of signal processors according to one aspect of the invention.

In the embodiment in FIG. 6, splitter/combiners 69 split or combine electrical signals when antenna 10 is transmitting or receiving signals respectively. In accordance with this embodiment, antenna 10 comprises at least one splitter/combiner 69 having at least two input terminals 64 and at least one output port 71. Input terminals 64 of splitter/combiner 69 are electrically coupled to antenna feed points 58 through electrical coupling 68. The splitter/combiners 69 and electrical coupling 68 are designed to produce a nominal 180 degree phase difference to, or from, signals at feed points 58. This can be accomplished in a number of ways including a "T" splitter-combiner and differential transmission line lengths, a 180 degree splitter/combiner, a balun, or other means known to those skilled in the art.

The electrical signals from output ports 71 can be combined in many different ways well known in the art. They can be combined using a 90 degree combiner to produce circular polarized hemispherical coverage or through other processing circuitry or to achieve polarization and/or angle diversity patterns through the use of other processing circuitry known to those skilled in the art.

A preferred embodiment utilizes the 90 degree combiner as the signal processor 62. The quadrature combination of the signals generates circular polarization with full hemisphere coverage using a single antenna connection 86 or alternatively, the electrical signals from output ports 71 can be combined through a four port ninety (90) degree hybrid combiner 90 to generate hemispherical coverage with left and right hand circular polarization from two outputs 86.

Figure 7:
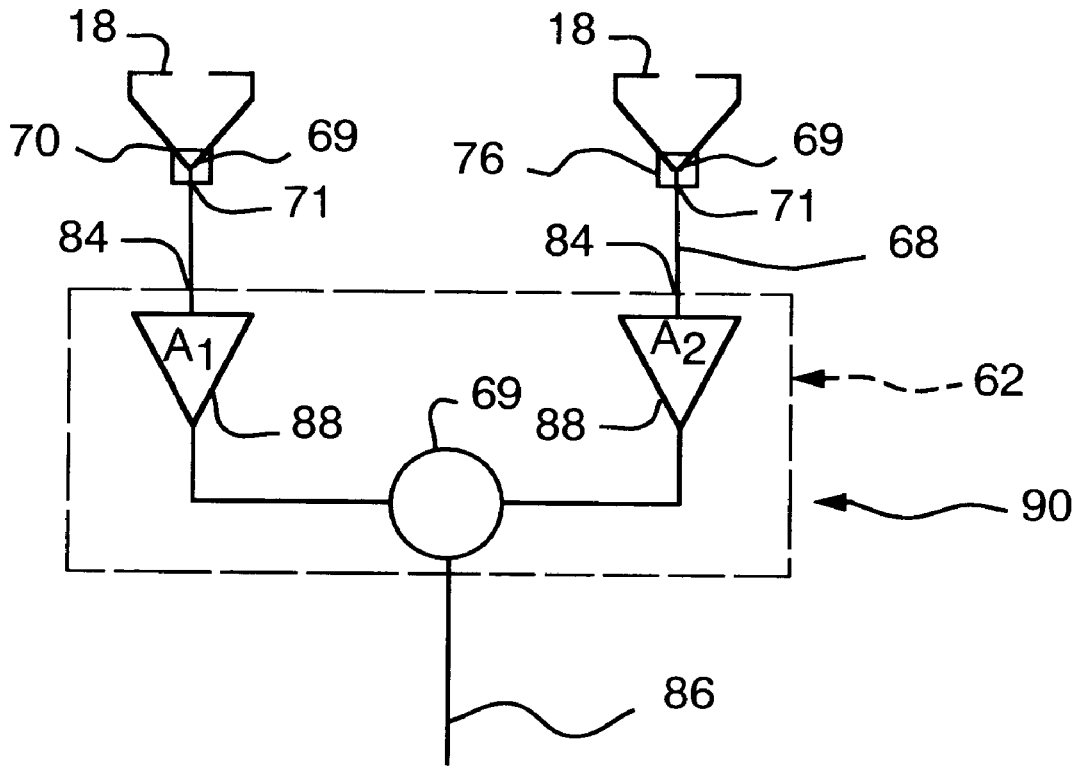
FIG. 7 is a schematic showing another embodiment of signal processors according to one aspect of the invention.
Figure 9A:
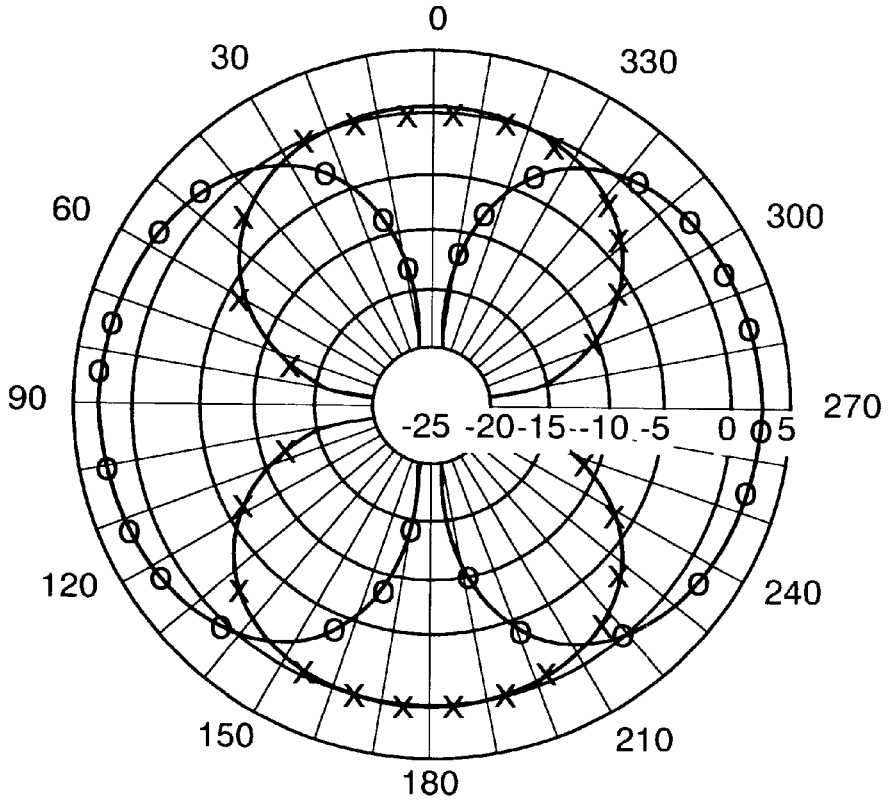
FIG. 9 is a schematic showing the azimuthal patterns generated by one embodiment of the present invention with an infinite ground plane.
Figure 9B:
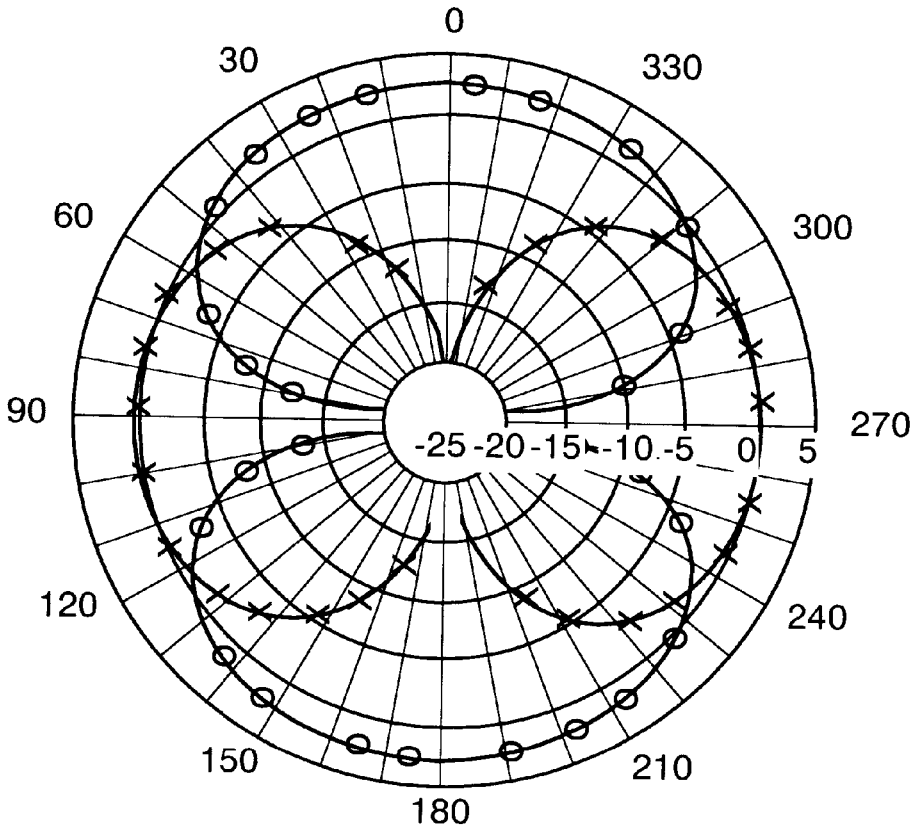

FIG. 7 illustrates another embodiment of the signal processing system according to one aspect of the invention. In this embodiment, output ports 71 of first and second splitter/combiners 70 and 76 are electrically coupled to input terminals 84 of signal processor 62. Within signal processor 62 are pre-amplifiers 88 and signal splitter/combiner 69. The individual ports 71 produce an orthogonal figure "8" shaped pattern as illustrated in FIG. 9. When the port outputs are combined, the figure "8" shaped pattern rotates in the azimuth plane by an amount determined by the preamplifier weighting. This configuration linearly combines terminal outputs 71 of antenna 10. The resulting pattern provides discrimination against multipath signals at orthogonal angles to the beam peak direction for a given polarization. Assuming a linear incoming polarization, signals arriving from other directions and/or polarizations will see a lower antenna gain. If an unwanted signal has the same polarization as a desired signal, the unwanted signal's gain reduces as the angular separation of the signals increases and would be completely rejected at 90 degrees separation where there is a pattern null. Signals with different linear polarizations have decreased gain due to polarization mismatch and pattern nulling at specific angles. Multipath and interference mitigation is therefore achieved via two means: polarization matching and pattern nulling.

Figure 8:
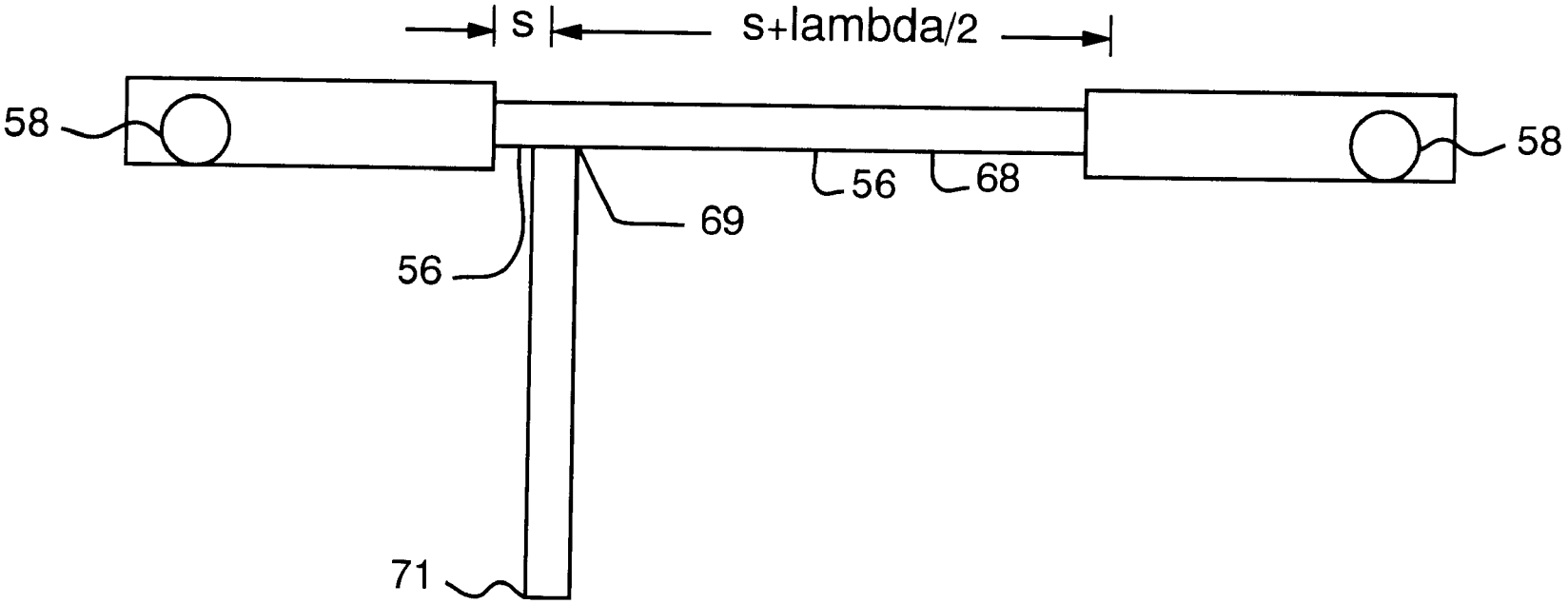
FIG. 8 is a schematic depicting an embodiment of the element pair and microstrip feed lines according to one aspect of the invention.

FIG. 8 illustrates a portion of another embodiment of the present invention that achieves a similar phase shift result as previously described using splitter/combiner 69 with phase shifting capabilities between antenna feed points 58. This embodiment is one in which the length of the electrical coupling 68 between separate antenna feed points 58 and two splitter/combiner input terminals differ by approximately one-half wavelength at the operating frequency of the antenna. This electrical coupling length difference combined with a "T" splitter/combiner results in combined signals with the desired phase shift properties as produced by splitter/combiner 69 with phase shifting abilities.

FIG. 9 illustrates the azimuthal patterns of the present invention. Antenna 10 generates independent orthogonal figure-eight-shaped, vertically polarized ("VP") $E_\theta$ patterns and horizontally polarized ("HP") $E_\phi$ patterns. These patterns are similar to those generated by crossed dipoles over a ground plane, with the added benefit of $E_\theta$ coverage down to the horizon. The signals from the output terminals 71 can be quadrature combined to generate circular polarization with full hemisphere coverage using a single antenna connection or alternatively the signals from the output terminals 71 can be combined through a four port 90 degree hybrid combiner to generate hemispherical coverage with left and right hand circular polarization outputs.

FIG. 10 illustrates the azimuth and elevation patterns achieved when quadrature combining the element pair outputs 71. The elements in this simulation are mounted on an infinite ground plane. The average power gain over the entire hemisphere in this case is 3 dBi with a maximum variation of +/−1.25 dB.

Figure 11:
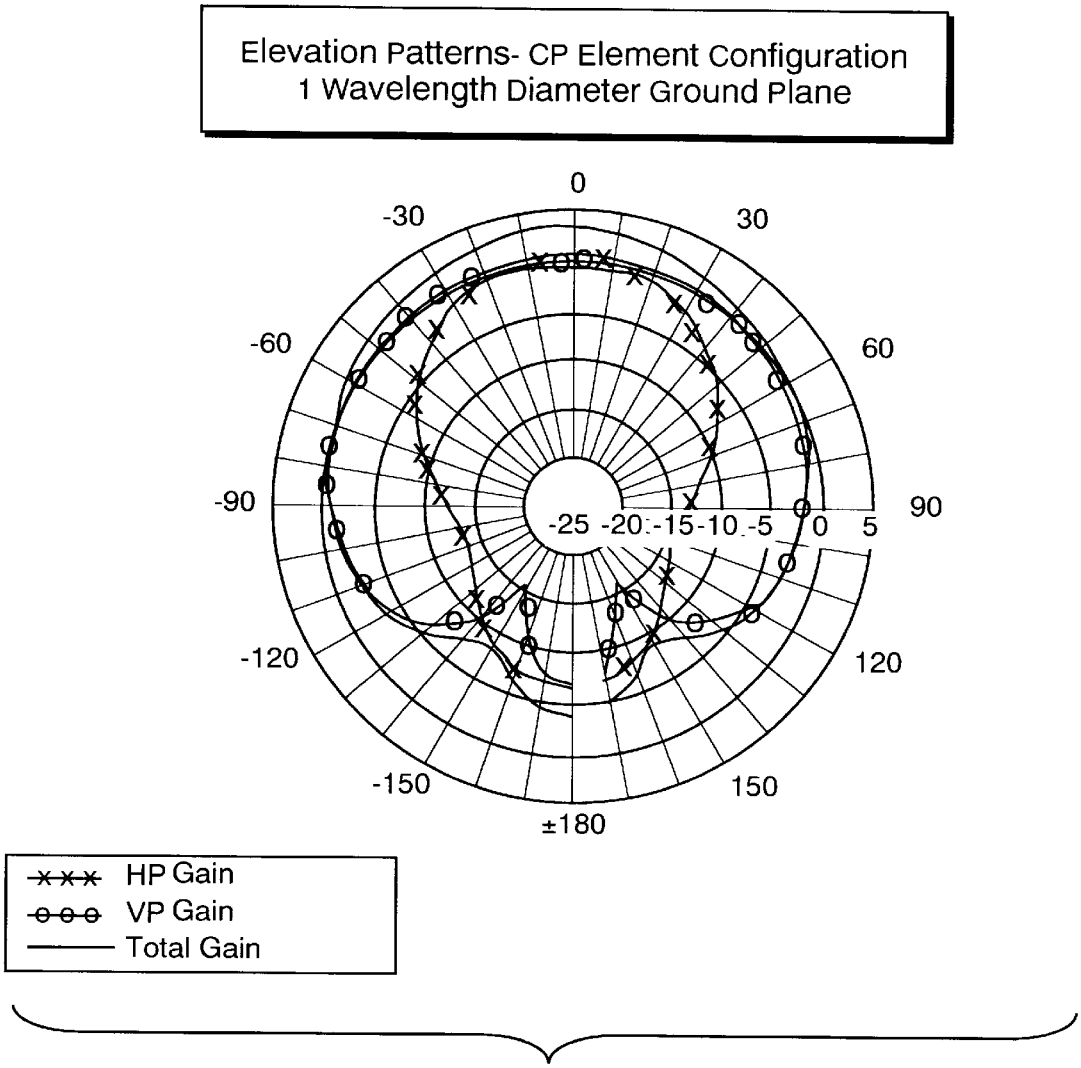
FIG. 11 is a schematic illustrating the elevation patterns of one embodiment of the present invention with a small ground plane.

FIG. 11 illustrates the gain by elevation of one embodiment of the present invention with a one (1) wavelength diameter circular ground plane for a predetermined operating frequency. The traces on the plot represent HP gain, VP gain and total gain. As shown in FIG. 10, the net result of the antenna design using a ground plane with a one wavelength diameter is some coverage below the horizon and the filling in of the horizontal $E_\phi$ pattern null at the horizon. If the antenna is mounted on a very large ground plane, even greater uniformity in pattern is achieved as illustrated in FIG. 10.

Figure 12:
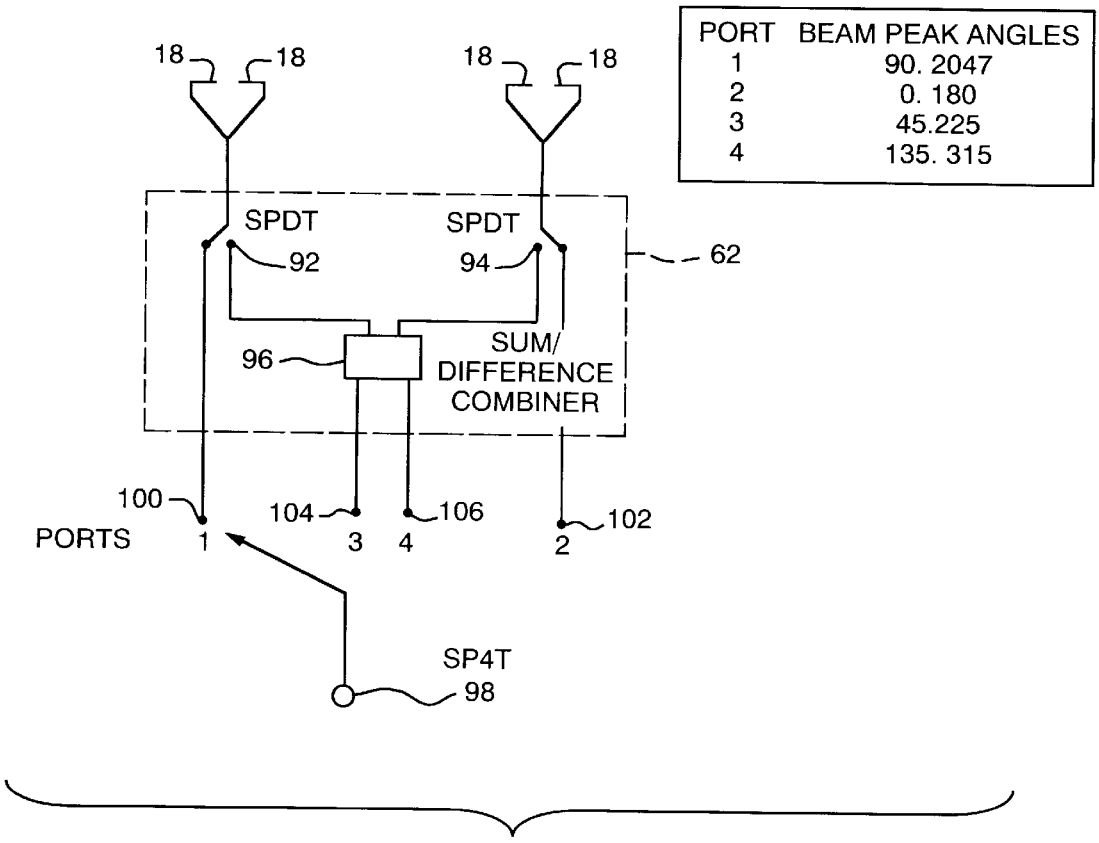
FIG. 12 is a schematic showing a configuration of the invention with four (4) output ports that are selectable via a 4PST switch.

FIG. 12 illustrates a configuration of the invention wherein the crossed doublets output ports 1 and 2 provide orthogonal radiation patterns and orthogonal polarizations. The port signals can be processed with signal processor 62 using techniques well known and published in the technical literature. These processing techniques include switching between ports, or combining the output ports with equal or system defined weights and/or phases to obtain the benefits of polarization and/or angle diversity. The embodiment in FIG. 12 is an example of a configuration of the present invention that could be utilized and does not require special processing circuitry, such as weighting amplifiers. Within signal processor 62 may be SPDT switches 92 and 94, and sum/difference combiner 96. In this case, four ports (two ports at any one time) can be made available to the user. The original ports 1 (100) and 2 (102) provide orthogonal figure eight radiation patterns in the azimuth plane and ports 3 and 4 provide figure eight patterns that are rotated + and −45 degrees from the port 1 pattern. The result is a rotated figure eight pattern as illustrated in FIG. 13.

Figure 13A:
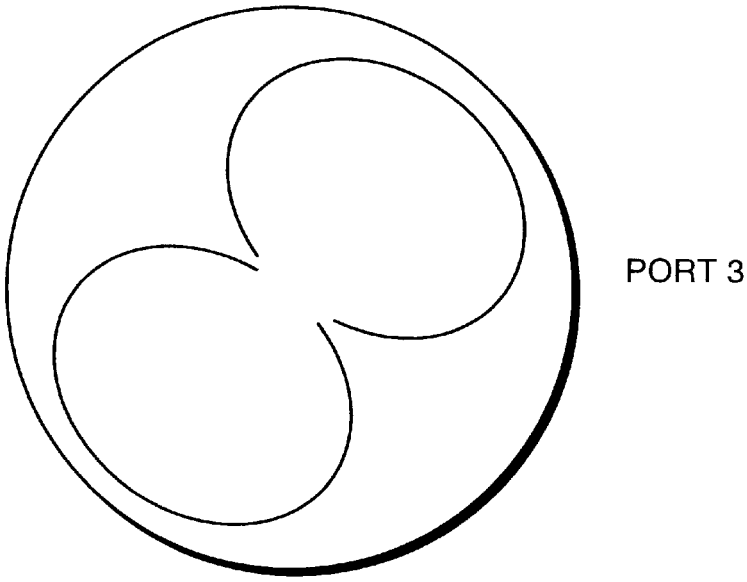
FIG. 13 illustrates the port 3 and port 4 azimuth patterns of the FIG. 12 configuration.
Figure 13B:
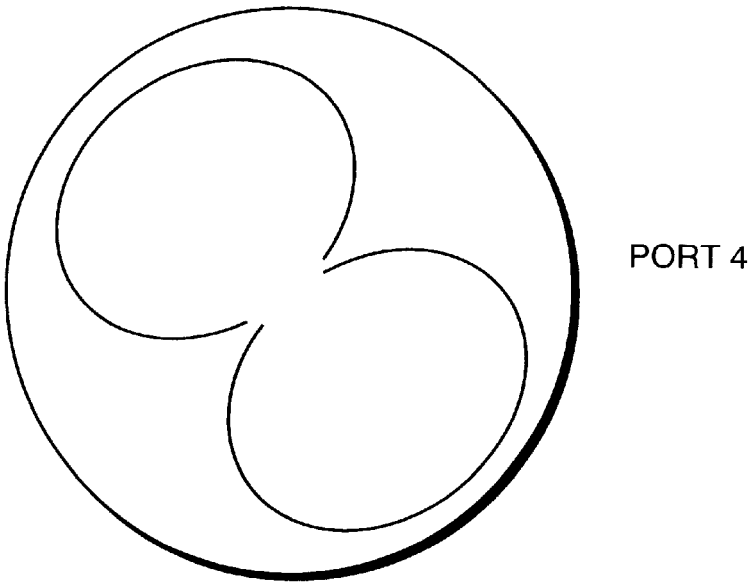

As shown in FIG. 13, the rotated patterns are obtained by switching the port 1 and 2 outputs via the SPDT switches 92 and 94 in FIG. 12 to a sum difference combiner 96 at ports 3 (104) and 4 (106). The system could be programmed to select the port that provides the best signal. Alternatively, the design may allow the user to manually activate the SPDT switches 92 and 94 and SP4T switch 98, as shown in FIG. 12, to select any one of the four ports to obtain the desired signal.

I claim:

1. An antenna comprising:

a ground plane having a first surface;

a pair of non-intersecting spaced antenna elements that are up to and including one quarter wavelength in length, extending from the first surface of the ground plane comprising first and second antenna elements with first and second feed points, respectively, wherein both antenna elements extend from the first surface of the ground plane and bend toward the antenna centerline that extends along an axis normal to the ground plane such that a vector representative of each of the elements has at least some horizontal component as viewed against the ground plane and such that the first and second antenna elements are symmetrically located about the antenna centerline; and at least one splitter/combiner having at least two input terminals and at least one output terminal, the input terminals electrically coupled to separate antenna feed points, whereby the splitter/combiner is for splitting and combining electrical signals when transmitting and receiving signals, respectively.

2. The antenna of claim 1 wherein at least one element is asymmetrically top loaded.

3. The antenna of claim 2 wherein the antenna elements are self-resonant.

4. The antenna of claim 2 wherein the greatest amount of top loading for each asymmetrically top-loaded antenna element is directed towards the antenna centerline that extends along an axis normal to the ground plane.

5. The antenna of claim 2 wherein the cross-section of the asymmetrical top loading for at least one antenna element is rectangular in shape.

6. The antenna of claim 1 wherein the feed points for the antenna element pair are a distance of up to and including approximately one-half wavelength apart at an operating frequency of the antenna.

7. The antenna of claim 1 further including at least one microstrip transmission line electrically coupled to at least one element feed point.

8. The antenna of claim 7 wherein the ground plane has a second surface opposite to the first surface and the microstrip transmission line is coupled to a dielectric substrate coupled to at least one surface of the ground plane.

9. The antenna of claim 1 wherein at least one splitter/combiner shifts the current phase of at least one electrical signal by one hundred eighty (180) degrees.

10. The antenna of claim 1 wherein the length of the electrical coupling between the separate antenna feed points and the two splitter/combiner input terminals differ by approximately one-half wavelength at an operating frequency of the antenna.

11. An antenna comprising:

a ground plane having a first surface;

a pair of non-intersecting spaced antenna elements that are up to and including one quarter wavelength in length, extending from the first surface of the ground plane, symmetrically about an antenna centerline, comprising first and second antenna elements with first and second feed points, respectively;

a second pair of spaced antenna elements of up to and including one quarter wavelength, orthogonal to the first pair of antenna elements and extending from the first surface of the ground plane, symmetrically about the antenna centerline, comprising third and fourth antenna elements with third and fourth feed points, respectively, such that the centerpoint between each pair of antenna elements is identical, wherein at least one antenna element extends from the first surface of the ground plane and bends toward the antenna centerline that extends along an axis normal to the ground plane such that a vector representative of the element has at least some horizontal component as viewed against the ground plane;

a first splitter/combiner having at least two input terminals and at least one output terminal, the input terminals electrically coupled to the first and second antenna feed points, whereby the splitter/combiner is for splitting and combining electrical signals when transmitting and receiving signals respectively; and a second splitter/combiner having at least two input terminals and at least one output terminal, the input terminals electrically coupled to the third and fourth antenna feed points, whereby the second splitter/combiner is for splitting and combining electrical signals when transmitting and receiving signals respectively.

12. The antenna of claim 11 wherein at least one element is asymmetrically top loaded.

13. The antenna of claim 12 wherein the antenna elements are self-resonant.

14. The antenna of claim 12 wherein the greatest amount of top loading for each asymmetrically top-loaded antenna element is directed towards the antenna centerline that extends along an axis normal to the ground plane.

15. The antenna of claim 12 wherein the cross-section of the asymmetrical top loading for at least one antenna element is rectangular in shape.

16. The antenna of claim 11 wherein the feed points for each antenna element pair are a distance of up to and including approximately one-half wavelength apart at an operating frequency of the antenna.

17. The antenna of claim 11 further including at least one microstrip transmission line electrically coupled to at least one element feed point.

18. The antenna of claim 17 wherein the ground plane has a second surface opposite to the first surface and the microstrip transmission line is coupled to a dielectric substrate coupled to at least one surface of the ground plane.

19. The antenna of claim 11 wherein at least one splitter/combiner shifts the current phase of at least one electrical signal by one hundred eighty (180) degrees.

20. The antenna of claim 11 further including a signal processor having at least two input terminals and at least one output terminal, the input terminals electrically coupled to the output terminals of the first and second splitter/combiners, respectively, the signal processor for splitting and combining electrical signals when transmitting and receiving signals, respectively.

21. The antenna of claim 20 wherein the signal processor is a ninety (90) degree hybrid combiner.

22. The antenna of claim 20 wherein the signal processor includes weighting amplifiers that are coupled to the output terminals of the first and second splitter/combiners, respectively.

23. The antenna of claim 21 wherein the signal processor includes at least one SPDT switch that switches the outputs of each of first and second ports to a sum difference combiner at third and fourth ports, to result in radiation patterns rotated by plus and minus forty five (45) degrees from the radiation patterns of the first and second ports.

24. The antenna of claim 23 comprising at least one SP4T switch allowing a user to select any one of the four ports to obtain the desired signal.

25. An antenna comprising an imaginary ground plane with first and second surfaces;

a first pair of spaced antenna elements extending from the first surface of the imaginary ground plane;

a second pair of spaced antenna elements orthogonal to the first pair of elements and extending from the first surface of the imaginary ground plane; such that the centerpoint between the first and second pairs of antenna elements is identical wherein at least one antenna element extends from the first surface of the imaginary ground plane and back toward the antenna centerline that extends along an axis normal to the imaginary ground plane such that a vector representative of the element has at least some horizontal component as viewed against the ground plane;

a third pair of spaced antenna elements extending from the second surface of the imaginary ground plane;

a fourth pair of spaced antenna elements orthogonal to the third pair of elements and extending from the second surface of the imaginary ground plane, such that the centerpoint between the third and fourth pair of antenna elements is identical wherein at least one antenna element extends from the second surface of the imaginary ground plane and back toward the antenna centerline that extends along an axis normal to the imaginary ground plane such that a vector representative of the element has at least some horizontal component as viewed against the ground plane;

a first splitter/combiner with an output port and a second splitter/combiner with an output port; and a signal processor;

wherein, the third pair and fourth pair of antenna elements are aligned in the same plane as the first pair and second pair of antenna elements thereby causing the first pair and third pair of antenna elements to form a first U-shaped dipole and the second pair and fourth pair of antenna elements to form a second U-shaped dipole; and each pair of antenna elements in the first U-shaped dipole is electrically coupled to the first splitter/combiner and each pair of antenna elements in the second U-shaped dipole is electrically coupled to the second splitter/combiner, all via a balanced transmission line; and the output ports of the first and second splitter/combiners are electrically coupled to the signal processor.

26. The antenna of claim 25 wherein the antenna elements are self-resonant.

* * * * *